United States Patent [19]

Müller et al.

[11] Patent Number: 4,688,917

[45] Date of Patent: Aug. 25, 1987

[54] DEVICE FOR WET PROCESSING OF PHOTOGRAPHIC FILMS

[75] Inventors: Jürgen Müller, Munich, Fed. Rep. of Germany; François P. Loots; Remi Vanhorebeek, both of Mortsel, Belgium

[73] Assignee: Agfa-Gevaert AG, Leverkusen, Fed. Rep. of Germany

[21] Appl. No.: 911,003

[22] Filed: Sep. 24, 1986

[30] Foreign Application Priority Data

Oct. 9, 1985 [DE] Fed. Rep. of Germany ..... 3535980

[51] Int. Cl.[4] ..... G03D 3/06; G03D 3/08

[52] U.S. Cl. ..... 354/320; 354/324

[58] Field of Search ..... 354/318, 319, 320, 321, 354/322, 324

[56] References Cited

U.S. PATENT DOCUMENTS

| | | | |
|---|---|---|---|
| 3,662,660 | 5/1972 | Layne | 354/320 |
| 3,682,082 | 8/1972 | Stievenart | 354/318 |
| 3,833,918 | 9/1974 | Stievenart et al. | 354/321 |
| 4,123,769 | 10/1978 | Fernandez et al. | 354/322 |

*Primary Examiner*—A. A. Mathews

*Attorney, Agent, or Firm*—Michael J. Striker

[57] ABSTRACT

A device for wet porocessing of photographic films comprises a film processing device and a storage container for storing a processing liquid supplied to the film processing device. The film processing device has a housing which is formed as a container in which a bath of the processing liquid is located and through which a film base is guided by means of rotary inlet rollers, rinsing rollers and squeezing rollers. The pair of rinsing rollers are each positioned in a cage which is extended to form a liquid-distributing channel connected to a respective feeding conduit leading from the storage container. A conduit system for continually renewing the processing liquid in the device is provided.

12 Claims, 2 Drawing Figures

DEVICE FOR WET PROCESSING OF PHOTOGRAPHIC FILMS

BACKGROUND OF THE INVENTION

The present invention relates to a device for so-called wet processing of photographic film bases.

Wet processing devices of the foregoing type normally include a roller pair for admitting a film base into the device, a roller pair for discharging the film base from the device, and a pair of rinsing rollers positioned in a bath-like container between the inlet rollers and discharge rollers, wherein the film base is conveyed between said rollers and is rinsed with a processing liquid.

A wet processing device of the type under consideration has been disclosed, for example in DE-OS No. 32 30 175. A plurality of transport rollers, provided in this device, define a transport plane for the film base being treated. The level of the processing liquid in the bath-like container lies above that transport plane. The film base is pulled through the bath so that the rollers merely fulfil the function of transport rollers and have no rinsing or squeezing rollers. Also the prior art fails to suggest that a relatively small amount of the processing liquid in the device can be continually renewed or regenerated.

SUMMARY OF THE INVENTION

It is an object of the present invention to provide an improved wet processing device for photographic films.

It is another object of the invention to provide a wet processing device in which with small volumes of the processing liquid in the device and strongly reduced oxidation possibilities for the processing liquid, a uniform distribution of the processing liquid at the rinsing rollers and a continual substitution of the processing liquid would be possible.

These and other objects of the invention are attained by a device for wet processing of photographic films, comprising a bath-like container filled with a processing liquid and forming a bath through which a film base is guided; an inlet roller pair admitting the film base into the device; a squeezing roller pair discharging the film base from the device; and a pair of rinsing rollers positioned between said inlet roller pair and said squeezing roller pair and receiving the film base guided in said container to wet the film base with the processing liquid, the rollers of said rinsing roller pair being positioned in housing cages, said cages being open toward a path of the film base guided in the device, each housing cage being formed with a liquid distributing channel at a side of a respective rinsing roller facing away from said bath, and liquid supplying conduits each connected to a respective distributing channel to supply the processing liquid to a respective rinsing roller.

Each liquid-distributing channel may extend at least over the entire width of the device and a maximal width of the film base, each liquid-distributing channel having a cross-section which narrows outwardly from a middle plane of the device.

Each liquid-distributing channel may have approximately the shape of truncated cone.

The supplying conduits may open into respective liquid-distributing channels in the highest or the lowest region of the respective channel.

The container may have side guide walls positioned in the direction of transportation of the film base, respectively between the inlet roller pair and the rinsing roller pair, and the rinsing roller pair and the squeezing roller pair.

The inlet roller pair and the squeezing roller pair may be positioned above said rinsing roller pair, said guide walls ascending from said housing cages in an outward direction.

The container may have further housing cages opening towards the path of the film base and enclosing the rollers of said inlet roller pair and of said squeezing roller pair, respectively.

The housing cages for lower inlet and squeezing rollers may open into respective discharge conduits for discharging the processing liquid from said container.

The container may have an upper portion forming the cages for accommodating the upper rollers of each pair and a lower portion forming the cages for accommodating the lower rollers of each pair, said lower portion having an upper edge which is positioned higher than lower edges of the housing cage of an upper rinsing roller, one of said guide walls being connected to the upper rinsing roller so that said rinsing rollers operate as transport rollers to move said film base through a splashing bath.

The planes of contact of the inlet rollers and the squeezing rollers may lie above said upper edge.

The plane of contact of said squeezing roller pair may lie above the plane of contact of said inlet roller pair.

The device may further include a processing liquid storage container and a pump, said supplying and discharging conduits being connected to said storage container from which the processing liquid is pumped by said pump into said supplying conduits.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
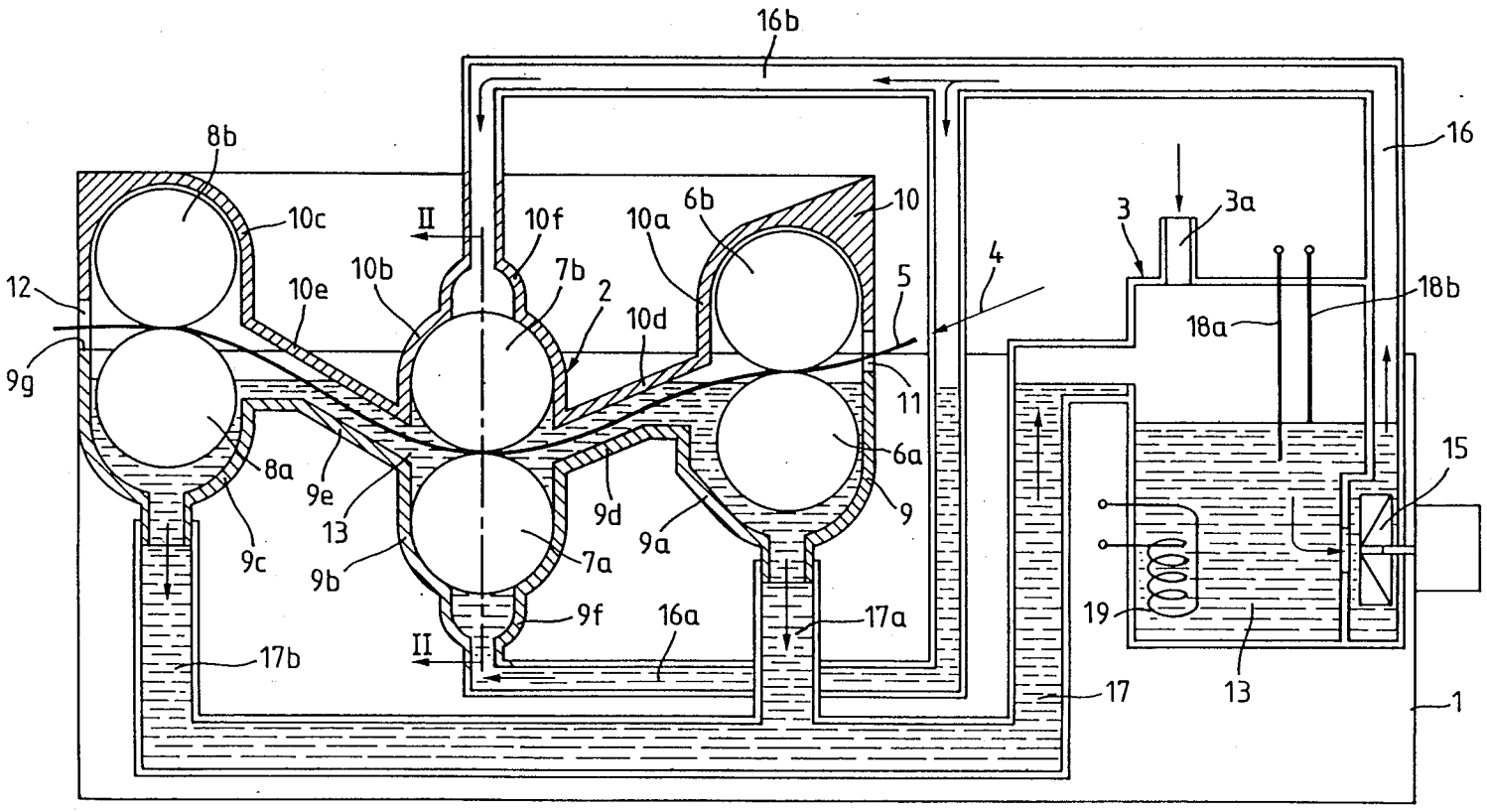
FIG. 1 is a partial sectional view of the device according to the invention, taken along line I—I of FIG. 2.

FIG. 1 illustrates a collecting and exposure bath 1 for a film processing device 2 and a supply container 3 for a processing liquid, connected to each other by conduits. Instead of the single bath 1, two baths for the processing device and for the supply container can be provided. In one or separate baths 1, the film processing device 2 and the supply container 3, and also rigid tubes or elastic hoses, forming the conduits are assembled in the known manner so that they are, for example installed or suspended or mounted at the walls of the bath by means of shells.

The processing device 2 includes three roller pairs *6a, 6b; 7a, 7b* and *8a, 8b* arranged one after the other in the direction of transportation 4 of a film base 5. The first one of the roller pairs *6a, 6b* is an inlet roller pair; the second roller pair 7a, 7b is a washing or rinsing roller pair for wetting the film base 5, and the third roller pair 8a, 8b is a squeezing roller pair. In accordance with its function, the rinsing roller pair 7a, 7b are arranged at the lowest level so that the plane of contact of bath rollers of the roller pair 7a, 7b with the film base forms the deepest or lowest region of the path of the film base. The lower rollers 6a, 7a, 8a are arranged in a bath-like container 9. The latter has concave portions 9a, 9b and 9c for accommodating rollers 6a, 7a, 8a, respectively and intermediate oblique walls 9a and 9c which guide the film base 5 between rollers 6a, 7a and 8a. Concave portions 9a and 9c for the lower inlet roller 6a and the lower squeezing roller 8a can be only approximately adjusted to the shape of the rollers 6a or 8a with a greater distance from the respective rollers. In contrast, the concave portion 9b for the lower rinsing roller 7a has the shape of a cage. Guide walls 9d, 9c extend,respectively from the upper inner end of the concave portion 9a or 9c obliquely downwardly to the upper edges of the concave portion 9b.

An upper housing portion 10 is superposed on the bathlike container 9. This upper housing portion has convex portions 10a, 10b and 10c for rollers 6b, 7b, 8b and intermediate guide walls 10d, 10e. These upper guide walls 10d, 10e extend somewhat parallel to guide walls 9d, 9e, respectively. Convex housing portions 10a, 10b, 10c can very closely enclose rollers 6b, 7b, 7c. All concave portions 9a, 9b, 9c and convex portions 10a, 10b, 10c are open for the path of the film base. Slots 11 and 12 are provided for admitting and discharging the film base 5 in the walls of the housing, perpendicular to the direction of transportation 4. These slots or openings are located between the bath-like container 7 and the upper housing portion 10.

Rollers 7a and 7b are continually rinsed with fresh processing liquid 13 and therefore the film base 5 is constantly wetted. A distributing channel 9f is formed at the apex of the concave portion 9b and a distributing channel 10f is formed at the apex of the convex portion 10b. Each of these channels is narrowed from the middle plane 14 in the transport direction 4 the both sides in the direction of the film base width as clearly seen from FIG. 2. Processing liquid 13 is pumped into these distributing channels 9f, 10f by means of a pump 15 and a main conduit 16 which is branched into two supply or feeding conduits 16a and 16b. The entrances of the feeding conduits 16a, 16b into the distributing channels 9f, 10f are positioned in the region of the middle plane 14, preferably somewhat perpendicular to the path of the film base.

The feeding conduits 16a, 16b can, however merge into the respective distributing channels 9f, 10f parallel to the same or at an angle thereto. It is also possible that the feeding conduits be provided at the respective ends of the distributing channels whereby the distributing channels would be then narrowed towards their other ends.

Upon pumping of the processing liquid 13 into the distributing channels 9f, 10f, the processing liquid is firstly distributed over the entire length of each channel whereby it rinses simultaneously the rinsing rollers 7a and 7 from above and below so that these rollers effect a uniform wetting of the film base 5 over the entire width thereof. Thereby the film base 5 guided through the rollers and processed can be continually supplied and wetted with the processing liquid without any problems. For discharging the processing liquid, discharge connections, which open into return conduits 17a, 17b, respectively, are provided at concave portions 9a, 9c for lower rollers 6a, 8a. Return conduits 17a, 7b merge into a common return conduit 17. The latter leads to the supply or storage container 3 and terminates at the level which is above the normal liquid level in the container 3. The processing liquid returned into the container 3 at the pressure below that of the pump 15 is then mixed with the fresh processing liquid whereby upon lowering of the level of the regenerated liquid fresh liquid can be added via a feeding conduit 3a. The control of the regeneration liquid feed can be carried out by level sensors 18a, 18b.

A heating coil 19 can be placed in the supply container 3. This coil can be controlled by thermostates which can be arranged either in the container 3 or conduits 16 or the walls of the container 9.

For a number of film bases of various types or various film development methods, it is expedient that the development would be carried out not only as a pure rinsing process but the film base 5 would be moved at a small portion of its path via a splashing bath, whereby a uniform rinsing would be provided by rotating transport rollers 7a, 7b and an additional wetting by splashing would be also attained. This is obtained according to FIG. 1 in that the amount of the processing liquid pump into the processing device is such that the liquid collected in the container 9 has a predetermined level. It is required that the upper edge 9g of the container 9 be positioned higher than the lower edges of the convex portion 10b for the upper rinsing roller 7b so that the latter, upon filling of the container 9 would be immersed in the liquid contained in container 9. In this case it can be expedient that valves be provided in the discharge or return conduits 17a, 17b. These valve can be made to automatically open when a desired level of the processing liquid in container 9 is exceeded. This level of the processing liquid should lie always below the lower edges of the inlet and outlet slots or openings 11 and 12.

Figure 2:
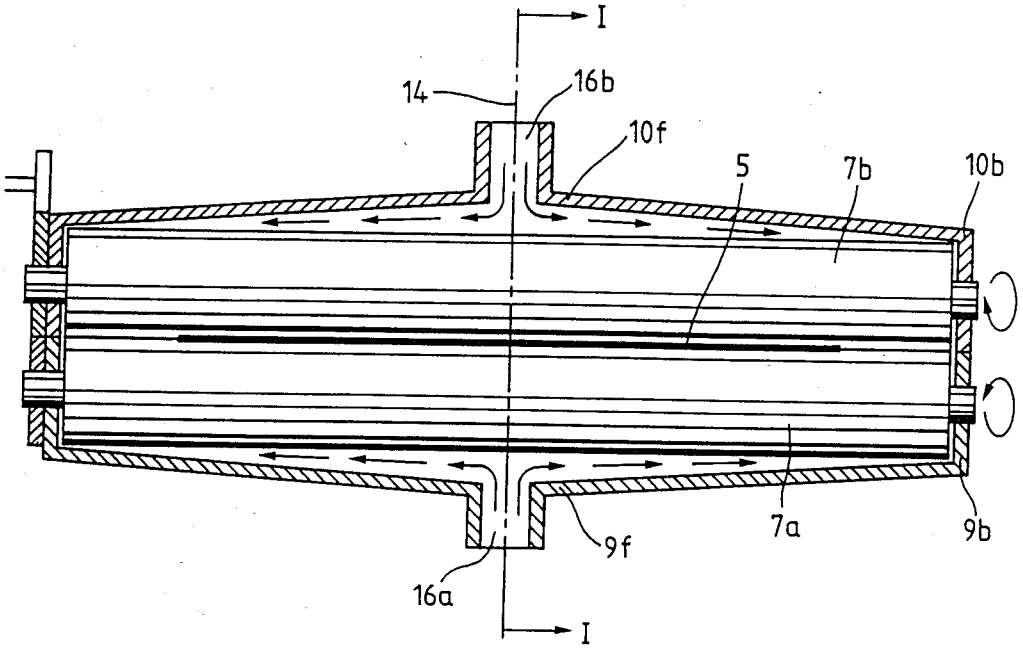
FIG. 2 is a sectional view taken along line II—II of FIG. 1.

The exemplified embodiment of the invention is shown in the drawings in the simplified manner. It is possible also to form the rinsing rollers 7a, 7b with their cages 9b, 10b and the distributing channels 9f, 10f as a single development unit and separate the same from the inlet rollers and squeezing rollers. In this case the inlet and squeezing rollers can be arranged at the same level with the rinsing rollers and positioned in small separate cages. The support and drive of the all roller pairs can be carried out in the known fashion as schematically shown in FIG. 2.

It will be understood that each of the elements described above, or two or more together, may also find a useful application in other types of devices for wet developing photographic films differing from the types described above.

While the invention has been illustrated and described as embodied in a device for wet developing photographic films, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a device for wet processing of photographic films, comprising a a bath-like container filled with a processing liquid and forming a bath through which a film base is guided; an inlet roller pair admitting the film base into the device; a squeezing roller pair discharging the film base from the device; and a pair of rinsing rollers positioned between said inlet roller pair and said squeezing roller pair and receiving the film base guided in said container to wet the film base with the processing liquid, the improvement comprising rollers (7*a*, 7*b*) of said rinsing roller pair being positioned in housing cages (9*b*, 10*b*), said cages being open toward a path of the film base guided in the device, each housing cage been formed with a liquid distributing channel (10*f*, 9*f*) at a side of a respective rinsing roller, facing away from said bath; and liquid supplying conduits (16*a*, 16*b*) each connected to a respective distributing channel to supply the processing liquid to a respective rinsing roller.

2. The device as defined in claim 1, wherein each liquid-distributing channel extends at least over the entire width of the device and a maximal width of the film base, each liquid-distributing channel having a cross-section which narrows outwardly from a middle plane of the device.

3. The device as defined in claim 2, wherein each liquid-distributing channel has approximately the shape of truncated cone.

4. The device as defined in claim 1, wherein said supplying conduits open into respective liquid-distributing channels in the highest or the lowest region of the respective channel.

5. The device as defined in claim 1, wherein said container has side guide walls (9*d*, 9*e*; 10*d*, 10*c*) positioned in the direction of transportation of the film base, respectively between the inlet roller pair and the rinsing roller pair, and the rinsing roller pair and the squeezing roller pair.

6. The device as defined in claim 5, wherein said inlet roller pair and said squeezing roller pair are positioned above said rinsing roller pair, said guide walls ascending from said housing cages in an outward direction.

7. The device as defined in claim 6, wherein said container has further housing cages (9*d*, 9*e*; 10*d*, 10*e*) opening toward the path of the film base and enclosing rollers of said inlet roller pair and of said squeezing roller pair, respectively.

8. The device as defined in claim 7, and further including discharge conduits (17*a*, 17*b*), and wherein the housing cages (9*a*, 9*c*) for lower inlet and squeezing rollers (6*a*, 8*a*) open into respective discharge conduits for discharging the processing liquid from said container.

9. The device as defined in claim 8, wherein said container has an upper portion forming the cages for accommodating upper rollers of each pair and a lower portion forming the cages for accommodating lower rollers of each pair, said lower portion having an upper edge (9*g*) which is positioned higher than lower edges of the housing cage (10*b*) of an upper rinsing roller one of said guide walls (10*d*) being connected to the upper rinsing roller so that said rinsing roller operate as transport rollers to move said film base through a splashing bath.

10. The device as defined in claim 9, wherein planes of contact of the inlet rollers and the squeezing rollers lie above said upper edge (9*g*).

11. The device as defined in claim 10, wherein a plane of contact of said squeezing roller pair lies above a plane of contact of said inlet roller pair.

12. The device as defined in claim 8; and further including a processing liquid storage container (3) and a pump (15), said supplying and discharging conduits (16, 17) being connected to said storage container from which the processing liquid is pumped by said pump into said supplying conduits.

* * * * *